US008082866B2

(12) United States Patent
Hirose et al.

(10) Patent No.: US 8,082,866 B2
(45) Date of Patent: Dec. 27, 2011

(54) SEWING MACHINE AND COMPUTER READABLE MEDIUM STORING SEWING MACHINE CONTROL PROGRAM

(75) Inventors: Hirokazu Hirose, Chiryu (JP); Akie Ukai, Nagoya (JP); Yoshio Nishimura, Nagoya (JP); Yoshinori Nakamura, Toyohashi (JP); Masaki Shimizu, Toyoake (JP); Kazumi Sai, Nagoya (JP); Satoru Makino, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 424 days.

(21) Appl. No.: 12/379,109

(22) Filed: Feb. 12, 2009

(65) Prior Publication Data

US 2009/0205549 A1 Aug. 20, 2009

(30) Foreign Application Priority Data

Feb. 15, 2008 (JP) ..... 2008-034565

(51) Int. Cl.
*D05B 19/00* (2006.01)

(52) U.S. Cl. ..... 112/470.04; 112/470.03

(58) Field of Classification Search ..... 112/272, 112/470.03, 470.04, 475.02, 475.03; 700/136–138
See application file for complete search history.

(56) References Cited

U.S. PATENT DOCUMENTS

| | | | | |
|---|---|---|---|---|
| 6,450,110 | B1 | 9/2002 | Bruhl et al. | |
| 6,470,813 | B2 * | 10/2002 | Ebata et al. | 112/102.5 |
| 6,718,893 | B1 * | 4/2004 | Kong | 112/102.5 |
| 6,776,112 | B2 * | 8/2004 | Bruehl et al. | 112/470.01 |
| 6,871,606 | B2 | 3/2005 | Schweizer | |
| 6,883,446 | B2 | 4/2005 | Koerner | |
| 6,959,657 | B1 * | 11/2005 | Duval | 112/272 |
| 7,373,891 | B2 * | 5/2008 | Koerner | 112/475.02 |
| 2002/0020334 | A1 * | 2/2002 | Bruhl et al. | 112/470.01 |
| 2003/0131773 | A1 * | 7/2003 | Schweizer | 112/102.5 |
| 2004/0099191 | A1 * | 5/2004 | Bruehl et al. | 112/275 |
| 2005/0145149 | A1 * | 7/2005 | Hooke | 112/315 |
| 2006/0213415 | A1 * | 9/2006 | Konig et al. | 112/475.01 |
| 2007/0227425 | A1 * | 10/2007 | Shimizu | 112/470.08 |
| 2007/0272136 | A1 | 11/2007 | Shimizu | |
| 2008/0078313 | A1 | 4/2008 | Hamajima | |

FOREIGN PATENT DOCUMENTS

| | | |
|---|---|---|
| JP | A-59-088194 | 5/1984 |
| JP | A-59-088196 | 5/1984 |
| JP | A-59-230593 | 12/1984 |
| JP | A-2001-353389 | 12/2001 |
| JP | A-2002-292175 | 10/2002 |
| JP | A-2006-517449 | 7/2006 |
| JP | A-2007-313159 | 12/2007 |
| JP | A-2008-079998 | 4/2008 |

* cited by examiner

*Primary Examiner* — Nathan Durham
(74) *Attorney, Agent, or Firm* — Oliff & Berridge, PLC

(57) ABSTRACT

A sewing machine capable of sewing a manually moved workpiece cloth in free motion includes a carrier that carries the workpiece cloth and being manually moved to move the workpiece cloth; a support element that movably supports the carrier; a movement amount detector that detects an amount of carrier movement; a specifier that specifies a stitch pitch; a comparator that produces a comparison of the amount of carrier movement with the stitch pitch; a regulator provided at the support element and that regulates carrier movement; and a controller that controls the regulator such that the amount of carrier movement does not exceed the stitch pitch based on the comparison produced by the comparator.

7 Claims, 9 Drawing Sheets

SEWING MACHINE AND COMPUTER READABLE MEDIUM STORING SEWING MACHINE CONTROL PROGRAM

CROSS-REFERENCE TO RELATED APPLICATIONS

This application is based upon and claims the benefit of priority from the prior Japanese Patent Application 2008-034565, filed on Feb. 15, 2008, the entire contents of which are incorporated herein by reference.

FIELD

The present disclosure relates to a sewing machine capable of sewing a workpiece cloth manually moved in free motion and a computer readable medium storing a control program for carrying out the free motion sewing operation.

BACKGROUND

Sewing machines have conventionally allowed execution of a utility sewing operation and a so called free motion sewing operation. In the utility sewing operation, a feed dog provided inside a sewing machine bed is moved back and forth to feed a workpiece cloth. In the free motion sewing operation, on the other hand, a user is allowed to manually move the workpiece cloth freely while keeping the feed dog lowered below a needle plate provided on the upper surface of the sewing machine bed. One of the disadvantages of the free motion sewing operation is that it produces poor looking stitches when the stitch pitch is inconsistent and misaligned. Formation of neat looking stitches with consistent or uniform stitch pitch requires a high degree of technical maturity on the part of the user.

JP 2002-292175 A discloses a sewing machine having an arm provided with a needle bar and a downwardly-oriented image sensor for capturing images of sewing operation. The needle bar extends downward from the extreme end of the arm and has sewing needle attached to it. The disclosed sewing machine executes free motion sewing operation by allowing a user to freely move a workpiece cloth placed on the upper surface of the sewing machine bed in manually adjusted feed amounts. Some of the images captured by the image sensor during the free motion sewing operation are taken into a microcomputer provided in the sewing machine as static images at predetermined time interval. By comparing the latest static image with the static image immediately preceding it, the microcomputer obtains the feed amount of the workpiece cloth based upon which the rotational speed of a sewing machine motor is altered; which is another way of saying that the speed of vertical movement of the needle bar is altered. Since the vertical movement of the needle bar is decelerated when there is relatively less feed amount and accelerated when there is relatively greater feed amount, even a user inexperienced in free motion sewing operation can form stitches in uniform stitch pitch.

According to the above configured sewing machine, since the speed of the needle bar movement, in other words, sewing speed of the free motion sewing operation is automatically changed depending on the feed amount of the workpiece cloth, sewing speed may be accelerated in greater degree than intended depending on the feed amount.

SUMMARY

An object of the present disclosure is to provide a sewing machine that allows a user to perform a free motion sewing operation in a predetermined specified stitch pitch under a sewing speed suitable for the user's technical maturity and in appropriate feed amount. Another object of the present disclosure is to provide a computer readable medium storing a control program to realize the above described features.

A sewing machine capable of sewing a manually moved workpiece cloth in free motion includes a carrier that carries the workpiece cloth and being manually moved to move the workpiece cloth; a support element that movably supports the carrier; a movement amount detector that detects an amount of carrier movement; a specifier that specifies a stitch pitch; a comparator that produces a comparison of the amount of carrier movement with the stitch pitch; a regulator provided at the support element and that regulates carrier movement; and a controller that controls the regulator such that the amount of carrier movement does not exceed the stitch pitch based on the comparison produced by the comparator.

According to the above described configuration, the carrier carrying the workpiece cloth is supported movably by the support element while being regulated by the regulator such that the amount of carrier movement does not exceed the specified stitch pitch. Thus, stitches having uniform stitch pitch can be formed without altering the rotational speed of the sewing machine motor during the free motion sewing operation. Such configuration allows even an inexperienced user to feed the workpiece cloth in an appropriate feed amount under the specified sewing speed suitable for the user's technical maturity, which in turn allows stitches to be formed on the workpiece cloth that does not exceed the specified stitch pitch to form neat looking stitches with uniform stitch pitch.

A computer readable medium storing a control program for sewing a manually moved workpiece cloth in free motion with a sewing machine including a carrier that carries the workpiece cloth and being manually moved to move the workpiece cloth, a support element that movably supports the carrier, a movement amount detector that detects an amount of carrier movement, a specifier that specifies a stitch pitch, a regulator provided at the support element and that regulates carrier movement, includes instructions for producing a comparison of the movement amount of the carrier with the stitch pitch and instructions for a controlling the regulator such that the amount of carrier movement does not exceed the stitch pitch based on the comparison produced by the comparator.

By reading and executing the control program stored in the computer readable medium, the effect provided by the sewing machine described earlier can be obtained.

BRIEF DESCRIPTION OF THE DRAWINGS

Other objects, features and advantages of the present disclosure will become clear upon reviewing the following description of the illustrative aspects with reference to the accompanying drawings, in which.

DETAILED DESCRIPTION

Figure 1:
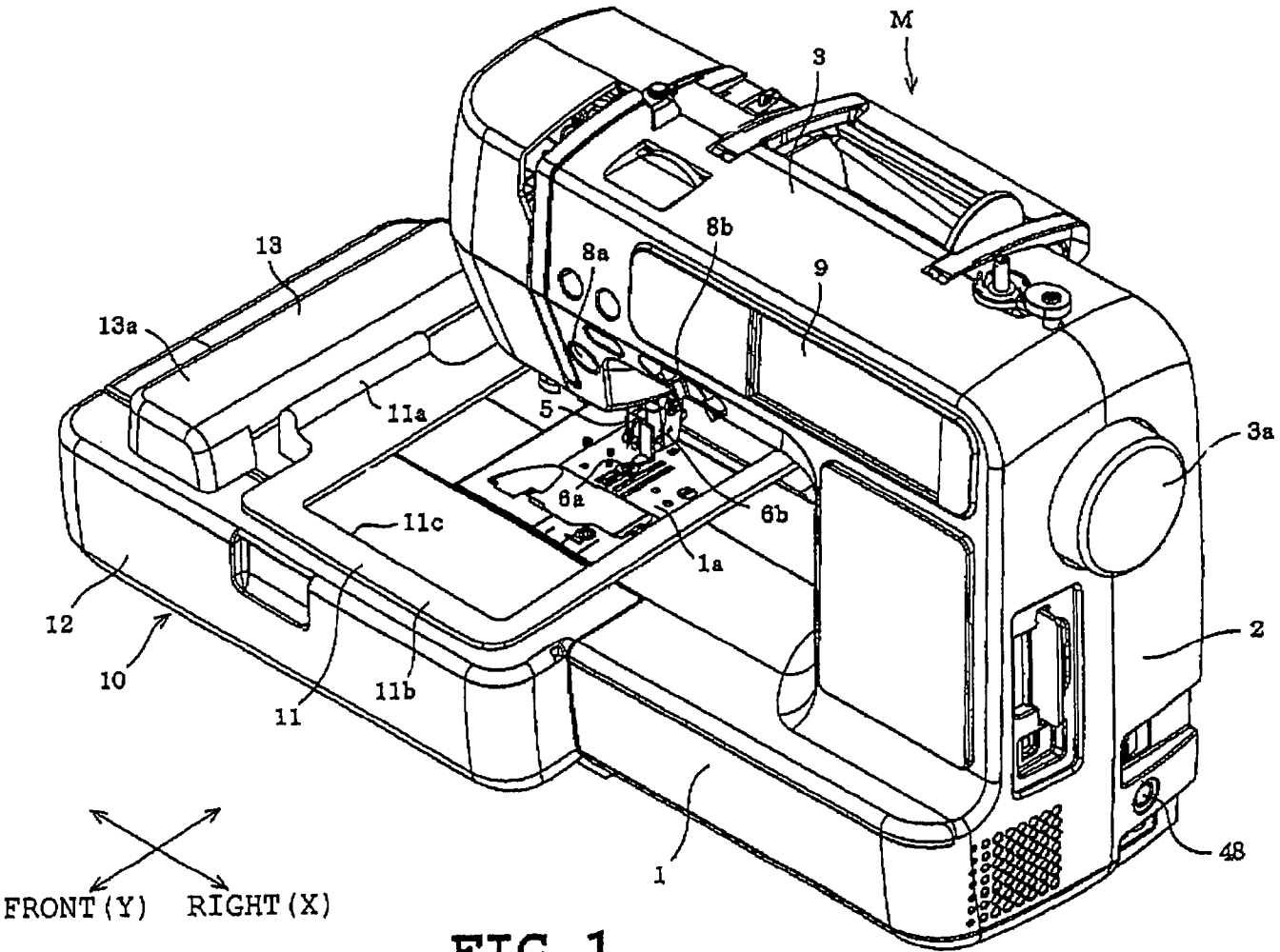
FIG. 1 depicts one exemplary embodiment of a sewing machine according to the present disclosure and shows an overall perspective view of the sewing machine with a carrier support attached.

One exemplary embodiment of the present disclosure will be described through a household electronic sewing machine described in FIGS. 1 to 8. FIG. 1 is a perspective view of an electronic embroiderable sewing machine M (hereinafter simply referred to as sewing machine M) in its entirety. Description will be given hereinafter with an assumption that the direction in which a user positions him/herself relative to sewing machine M is the front.

Sewing machine M includes a laterally extending bed 1, an upwardly extending pillar 2 standing on the right end of bed 1, and an arm 3 extending leftward over bed 1 from the upper end of pillar 2. Provided inside arm 3 are a main shaft (not shown) and a sewing machine motor 4 (refer to FIG. 5). The main shaft extends laterally in the left and right direction and is driven by sewing machine motor 4. The main shaft may also be rotated manually by a hand pulley 3*a* provided at the right side of arm 3.

Provided at the extreme end of arm 3 are a needle bar (not shown) having a sewing needle attached to it and a presser bar 6*b* having a presser foot 6*a*, used in a later described free motion sewing operation, attached to it. Though not shown, arm 3 includes components such as a needle-bar drive mechanism, a needle-bar swing mechanism, a thread take-up drive mechanism, and a presser-bar drive mechanism. Needle-bar drive mechanism vertically moves the needle bar based on the rotation of the main shaft. Needle-bar swing mechanism swings the needle bar in a direction orthogonal to cloth feed direction (in this case, the needle bar is swung laterally). Thread take-up drive mechanism vertically moves a thread take-up in synchronism with the vertical movement of the needle bar. Presser-bar drive mechanism vertically moves presser bar 6*b*. Arm 3, further contains a needle position sensor 7 (refer to FIG. 5) that detects vertical positioning of sewing needle 5. Needle position sensor 7 comprises a lower sensor (not shown) that senses the lowermost positioning of sewing needle 5 and an upper sensor (not shown) that senses the uppermost positioning sewing needle 5.

Bed 1 has a needle plate 1*a* provided on its upper surface. Though not shown, provided below needle plate 1*a* are components such as a feed mechanism that vertically and longitudinally moves a feed dog, a horizontal shuttle mechanism containing a bobbin thread bobbin and cooperating with sewing needle 5 in forming stitches, and a thread cutter that cuts a needle thread and a bobbin thread. At the rear sidewall of bed 1, a switching lever (not shown) is provided that, when operated, switches the feed dog between an active state where the workpiece cloth is fed by the feed dog moving above and below needle plate 1*a*, and an inactive state where the feed dog stays below needle plate 1*a*. Though not described in detail, attachment of a later described carriage support 10 to sewing machine M causes the switching lever to switch the feed dog to the inactive state.

On the front face of arm 3, components such as a start/stop switch 8*a* for instructing the start and stop of a sewing operation and a speed adjustment dial 8*b* for setting sewing speed (rotational speed of the sewing machine main shaft), and various other types of switches are provided. On the front face of pillar 2, a laterally elongate liquid crystal display 9 (hereinafter simply referred to as LCD 9) is provided for displaying items like various types of patterns such as utility patterns and embroidery patterns, names of functionalities to be executed during the sewing operation, and various messages (refer to FIG. 7). On the front face of LCD 9, a touch panel 9*a* comprising touch keys composed of transparent electrodes is provided for user operation. The user is allowed to select the desired sewing pattern and set various parameters such as a later described stitch pitch p through the touch keys.

Figure 2:
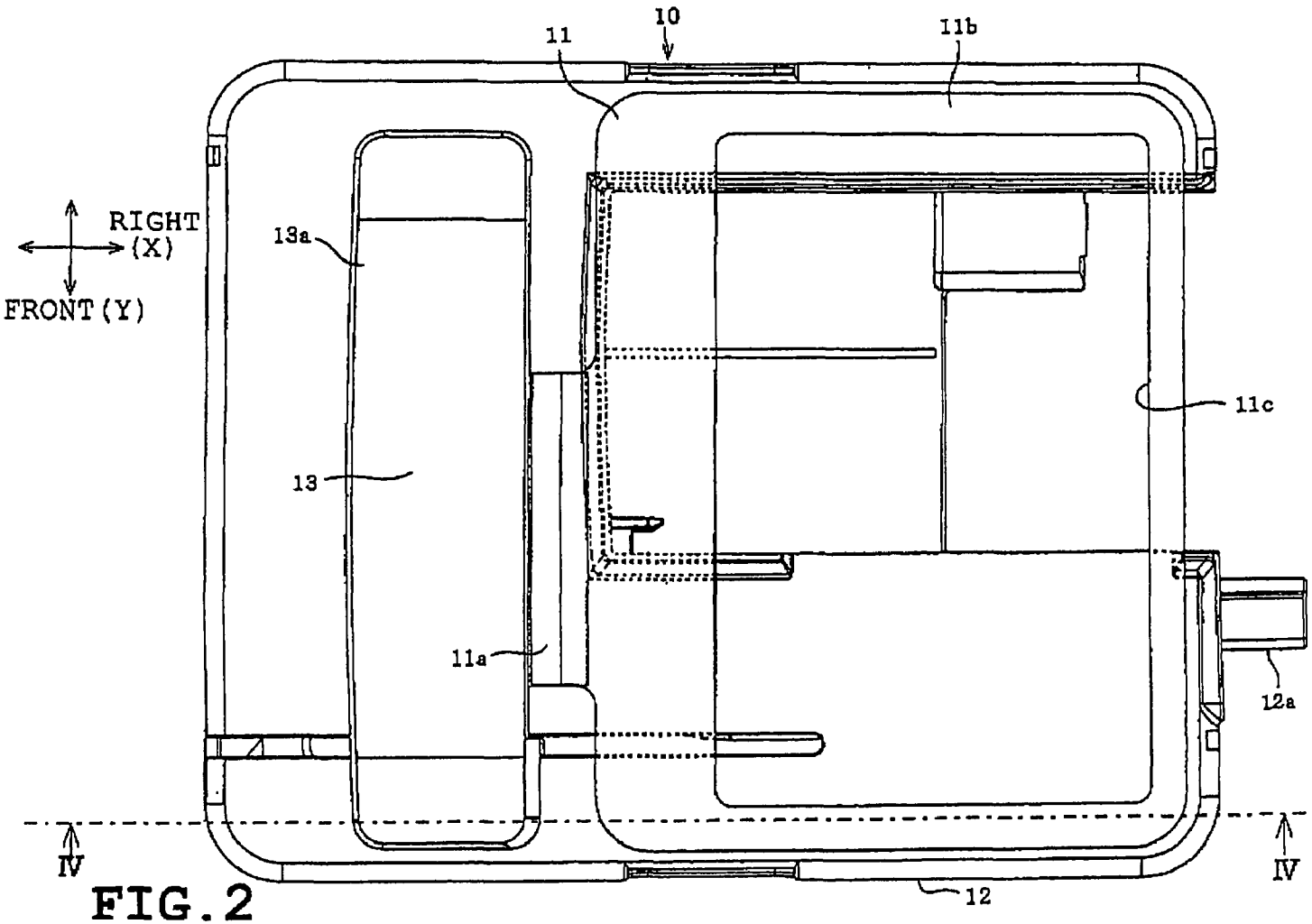
FIG. 2 is a plan view of the carrier support and a carrier.

On the left side of bed 1, carriage support 10 is attached removably. Carriage support 10 supports a carrier 11 for placing a workpiece cloth CL (only shown in FIG. 8) so as to be movable in 2 predetermined directions (X-direction and Y-direction). Carriage support 10 will be further described with reference to FIGS. 2 to 4. FIG. 2 is a plan view of carriage support 10 and FIG. 3 describes the internal structure of carriage support 10. FIG. 4 is a vertical cross sectional view taken along line V-V of FIG. 2. The present exemplary embodiment is described with an assumption that the direction in which bed 1 extends, that is, the left and right direction (lateral direction) is the X-direction and the front and rear direction (lateral direction) orthogonal to it is the Y-direction.

Carriage support 10 comprises a body 12 which is coplanar with the upper surface of bed 1 when carriage support 10 is attached to bed 1, and a movable member 13 provided movably above the upper surface of body 12 in the X-direction. Movable member 13 is provided with a carriage 14 (refer to FIGS. 3 and 4) for attachably/detachably receiving carrier 11 and being movable in the Y-direction.

Figure 3:
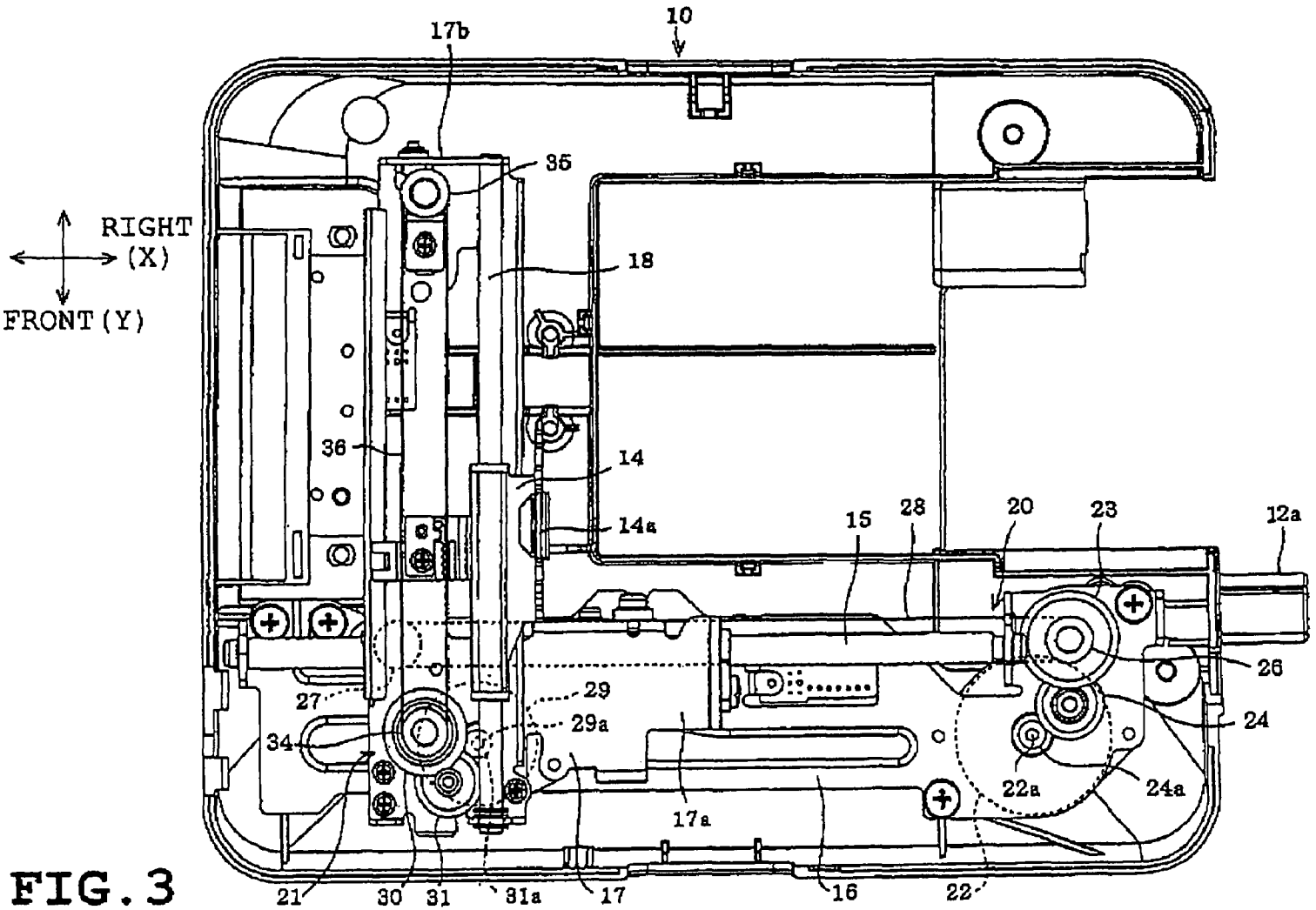
FIG. 3 is a transverse cross sectional view showing an interior structure of the carrier support.
Figure 4:
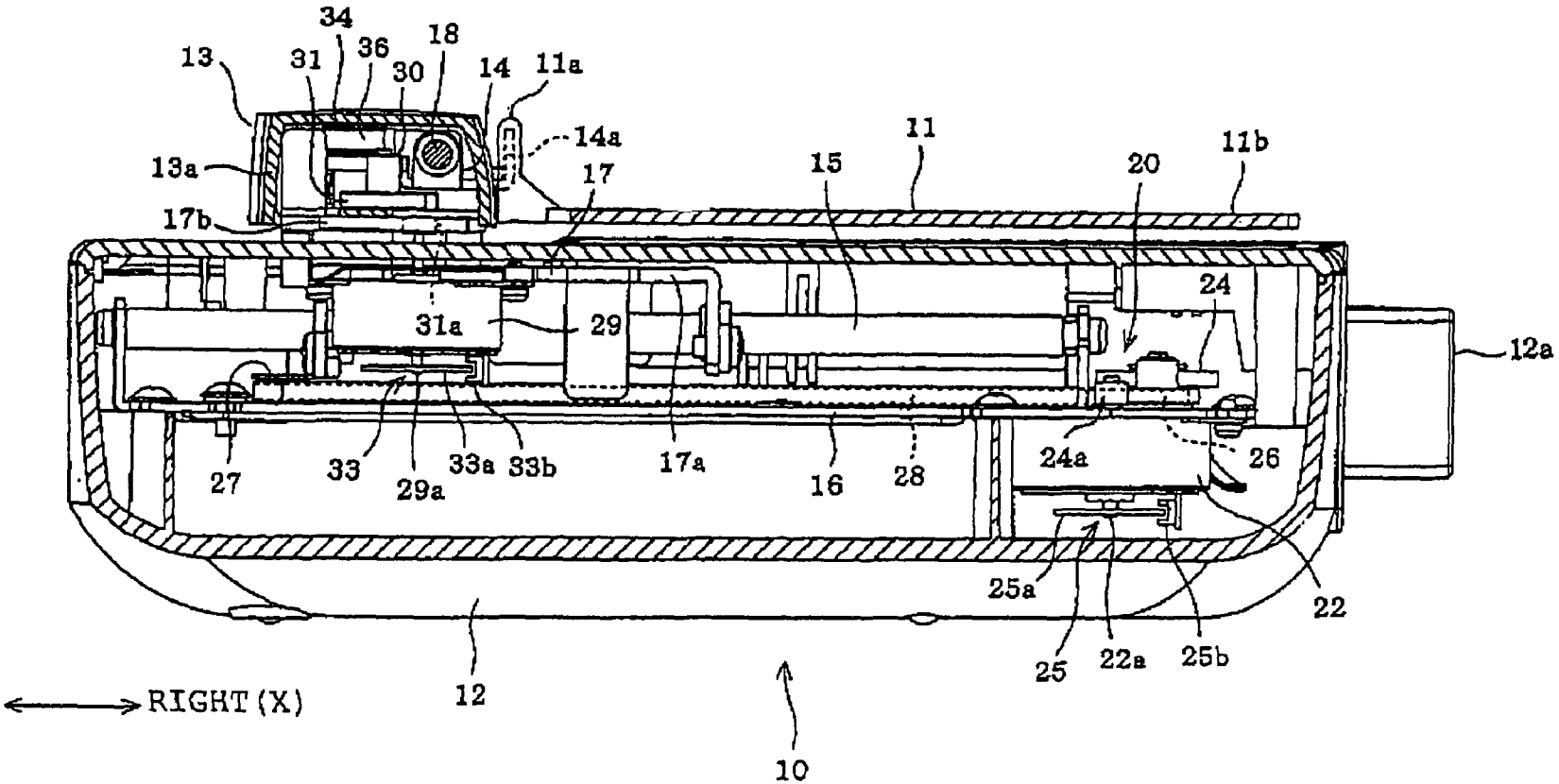
FIG. 4 is a vertical cross sectional view taken along line I-IV of FIG. 2.

As detailed in FIGS. 3 and 4, a fixture frame 16 extending in the left and right direction is provided inside body 12. Fixture frame 16 has an X-directional guide shaft 15 oriented in the X-direction secured to it. X-directional guide shaft 15 is provided with a movable frame 17 which is movable in the X-direction. Movable frame 17 is provided integrally with a support frame 17*a* provided within body 12 and a longitudinally extending frame body 17*b*. Frame body 17*b* is supported at its upper side by support frame 17*a* and is contained in an exterior case 13*a* of movable member 13. Movable frame 17 is allowed to move in the X-direction by the guidance of support frame 17*a* slidably engaged with X-directional guide shaft 15. Frame body 17*b* has a longitudinally oriented Y-directional guide shaft 18 secured to it. Carriage 14 being slidably guided to Y-directional guide shaft 18 is allowed to move in the Y-direction. Carriage 14 has an engagement subject 14*a* which receives an engagable/disengageable engagement 11*a* of a later described engagement subject 11*a* of carrier 11.

Carrier 11 is generally rectangular in form and is provided integrally with a body 11*b* in thin frame form and engagement subject 11*a* provided at the outer edge of body 11*b*. Body 11*b* encloses a wide rectangular opening (sewing area) 11*c* within which free motion sewing is executed. Workpiece cloth CL rests upon the 4 sides of body 11*b*. Engagement 11*a* of carrier 11*a* is attachably/detachably attached to engagement subject 14*a* of carriage 14. Carrier 11 is thus supported by carriage support 10 so as to be movable in the X- and Y-directions on a given plane (substantially horizontal surface) over bed 1.

Next, a description will be given on a first regulator 20 and a second regulator 21 provided at carriage support 10. First regulator 20 regulates the X-directional movement of carrier 11 whereas second regulator 21 regulates the Y-directional movement of carrier 11. First regulator 20 comprises, for example, a brake motor (hereinafter referred to as an X-shaft brake motor 22) configured by a pulse motor and an X-shaft transmission mechanism 23 that transforms the X-directional movement of carrier 11 into rotary movement of X-shaft brake motor 22.

Body 12 of carriage support 10 contains X-shaft brake motor 22 and deceleration gear mechanism 24 disposed at the right side of fixture frame 16. X-shaft brake motor 22 is secured on the underside of fixture frame 16 such that its rotary shaft 22*a* extends through fixture frame 16. On the upper portion of rotary shaft 22*a*, a gear element 24*a* is provided that is in mesh with deceleration gear mechanism 24 and a later described X-shaft encoder 25 (refer to FIG. 4) is provided below X-shaft brake motor 22. Deceleration gear mechanism 24 is provided with a pulley 26 (refer to FIG. 3) whereas a pulley 27 is provided rotatably at the left side of fixture frame 16. An endless timing belt 28 connected to support frame 17*a* of movable frame 17 is wound around pulleys 26 and 27.

When carrier 11 is moved in the X-direction, the linear movement is transmitted to pulley 26 as a rotary movement through movable frame 17 and timing belt 28 to rotate deceleration gear mechanism 24 and X-shaft brake motor 22. Above described components such as deceleration gear mechanism 24, gear element 24*a*, pulleys 26 and 27, and timing belt 28 constitute X-shaft transmission mechanism 23.

Second regulator 21 comprises, for example, a brake motor (hereinafter referred to as an Y-shaft brake motor 29) configured by a pulse motor and an Y-shaft transmission mechanism 30 that transforms the Y-directional movement of carrier 11 into rotary movement of Y-shaft brake motor 29.

Body 12 of carriage support 10 contains Y-shaft brake motor 29 disposed on the underside of support frame 17*a* and a deceleration gear mechanism 31 is provided on the upper side of frame body 17*b* within exterior case 13*a* of movable member 13. Y-shaft brake motor 29 has a rotary shaft 29*a* that extends through support frame 17*a* and frame body 17*b* and at the upper portion of rotary shaft 29*a*, a gear element 31*a* is provided that is in mesh with deceleration gear mechanism 31. A later described Y-shaft encoder 33 is provided below Y-shaft brake motor 29. Deceleration gear mechanism 31 is provided with a pulley 34 whereas a pulley 35 (refer to FIG. 3) is provided rotatably at the rear side of frame body 17*b*. An endless timing belt 36 connected to carriage 14 is wound around pulleys 34 and 35.

When carrier 11 is moved in the Y-direction, the linear movement is transmitted to pulley 34 as a rotary movement through carriage 14 and timing belt 36 to rotate deceleration gear mechanism 31 and Y-shaft brake motor 29. Above described components such as deceleration gear mechanism 31, gear element 31*a*, pulleys 34 and 35, and timing belt 36 constitute Y-shaft transmission mechanism 30.

At the right end of body 12 of carriage support 10, a connector 12*a* is provided that electrically connects X-shaft brake motor 22 and Y-shaft brake motor 29 to a later described controller 40 of sewing machine M. Referring back to FIG. 1, when carriage support 10 is attached to sewing machine M, a male connector 12*a* is connected to a female connector not shown, for example, to establish an electrical connection between X- and Y-shaft brake motors 22 and 29 and controller 40. Thus, X- and Y-shaft brake motors 22 and 29 are controlled independently by controller 40 to generate braking force by the so called holding torque produced by excitation or energization of X- and Y-shaft brake motors 22 and 29.

More specifically, X-shaft brake motor 22, when excited, maintains its unrotatable state by attraction occurring between its rotor and stator. Braking force (holding torque) thus produced is transmitted to movable frame 17 through deceleration gear mechanism 24, pulley 26 and timing belt 28 to prohibit the X-directional movement of carrier 11. Y-shaft brake motor 29 is controlled in the same way to transmit its braking force to carriage 14 through deceleration gear mechanism 31, pulley 34 and timing belt 36 to prohibit the Y-directional movement of carrier 11.

A description will now be given on X- and Y-shaft encoders 25 and 33. As can be seen in FIG. 4, X-shaft encoder 25 is an optical rotary encoder comprising a rotary disc 25 disposed in the proximity of X-shaft brake motor 22 and a photo interrupter 25*b*. More specifically, rotary disc 25*a* is secured at the lower portion of rotary shaft 22*a* of X-shaft brake motor 22 and has multiple slits defined at predetermined circumferential intervals. Photo interrupter 25*b* comprises a light emitting element and a light receiving element confronting each other over the slits of rotary disc 25*a*. Photo interrupter 25*b* outputs a so called A-phase signal and a B-phase signal, mutually displaced in phase, to controller 40 in order to detect the amount of rotation of X-shaft brake motor 22 and its rotational direction. That is, X-shaft encoder 25 being provided at X-shaft brake motor 22 is configured to detect X-directional movement amount (movement amount relative to the stationary carriage support 10) of carrier 11 via X-shaft transmission mechanism 23.

Similarly, Y-shaft encoder 33 is an optical rotary encoder being similar in configuration to X-shaft encoder 25, and comprises a rotary disc 33*a* and a photo interrupter 33*b*. Rotary disc 33*a* is secured at the lower portion of rotary shaft 29*a* of Y-shaft brake motor 29 with multiple slits defined on it. Y-shaft encoder 33 being provided at Y-shaft brake motor 29 is configured to detect relative Y-directional movement amount of carrier 11.

Figure 5:
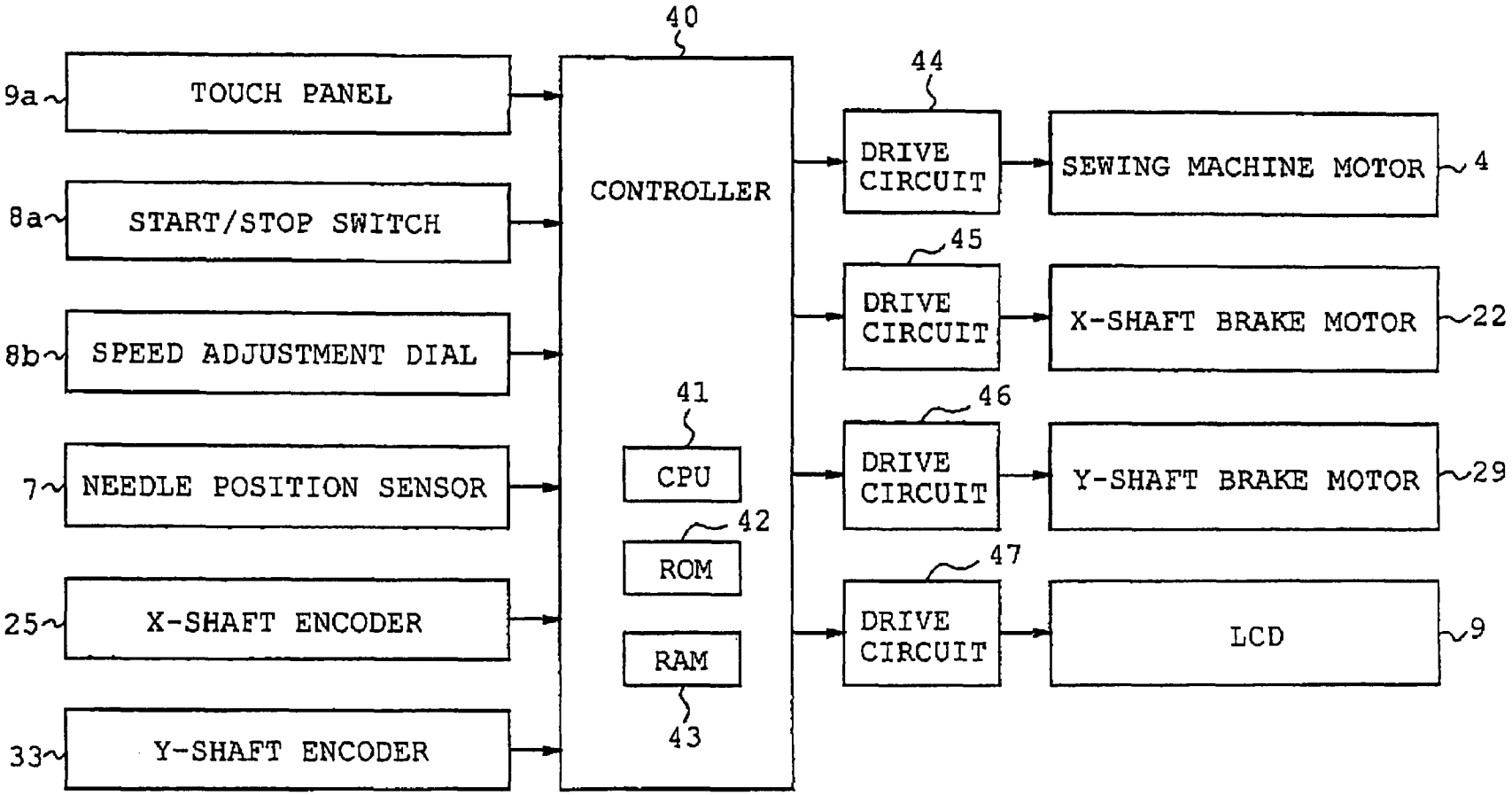
FIG. 5 is a block diagram indicating an electrical configuration of the sewing machine.

A control system of sewing machine M will be described with reference to a block diagram shown in FIG. 5. Controller 40 of sewing machine M is configured primarily by a microcomputer and includes components such as a CPU 41, a ROM 42, and a RAM 43.

Controller 40 establishes connections with components such as start/stop switch 8*a*, speed adjustment dial 8*b*, touch panel 9*a*, needle position sensor 7, X-shaft encoder 25, Y-shaft encoder 33 and drive circuits 44, 45, 46, and 47 for sewing machine motor 4, X-shaft brake motor 22, Y-shaft brake motor 29, and LCD 9.

Controller 40 is responsible for operations such as calculation of a coordinate representing the current position of carrier 11 based on the count of detection signal produced by X-shaft encoder 25 and Y-shaft encoder 33, respectively. ROM 42 stores items such as various pattern data of utility patterns and embroidery patterns, and sewing control programs. RAM 43 allocates data memory for storing the specified stitch pitch, memory being constantly updated with coordinates representing the current position of carrier 11, and various other work memory for purposes such as buffering and counting. Controller 40 executes sewing operation of workpiece cloth CL through control of actuators such as sewing machine motor 4, X-shaft brake motor 22, and Y-shaft brake motor 29 based on the sewing control program and pattern data.

Sewing machine M of the present exemplary embodiment is provided with a plurality of sewing modes such as a free motion sewing mode, utility sewing mode, and embroidery sewing mode. Among the sewing modes, free motion sewing mode allows a free motion sewing operation to be executed with attachment of carriage support 10, in which workpiece cloth CL is manually transferred through transfer of carrier 11. Though not described in detail, utility sewing mode allows the workpiece cloth to be sewn while longitudinally feeding the workpiece cloth by the feed dog without attachment of carriage support 10, Embroidery sewing mode allows embroidery sewing of the workpiece cloth while moving carriage 14 attachably/detachably receiving an embroidery frame holding the workpiece cloth in the X- and Y-directions. In the embroidery sewing mode, X-shaft brake motor 22 and Y-shaft brake motor 29 serve as drive motors for transferring the embroidery frame and X-shaft transmission mechanism 23 and Y-shaft transmission mechanism 30 serve transfer mechanisms for transferring the embroidery frame.

Figure 6A:
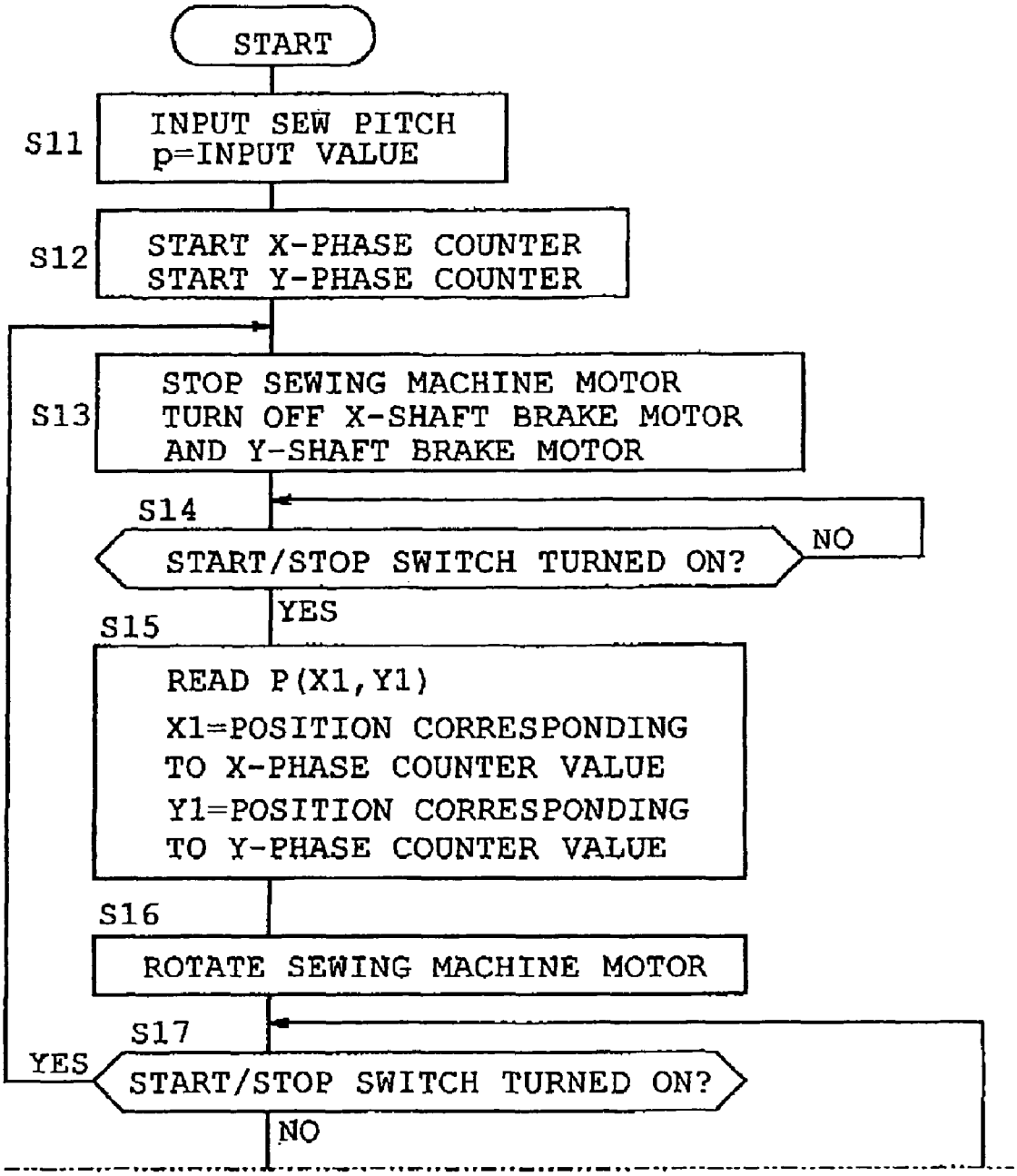
FIGS. 6A and 6B indicate a flowchart of a sew control in a free motion sewing mode.
Figure 6B:
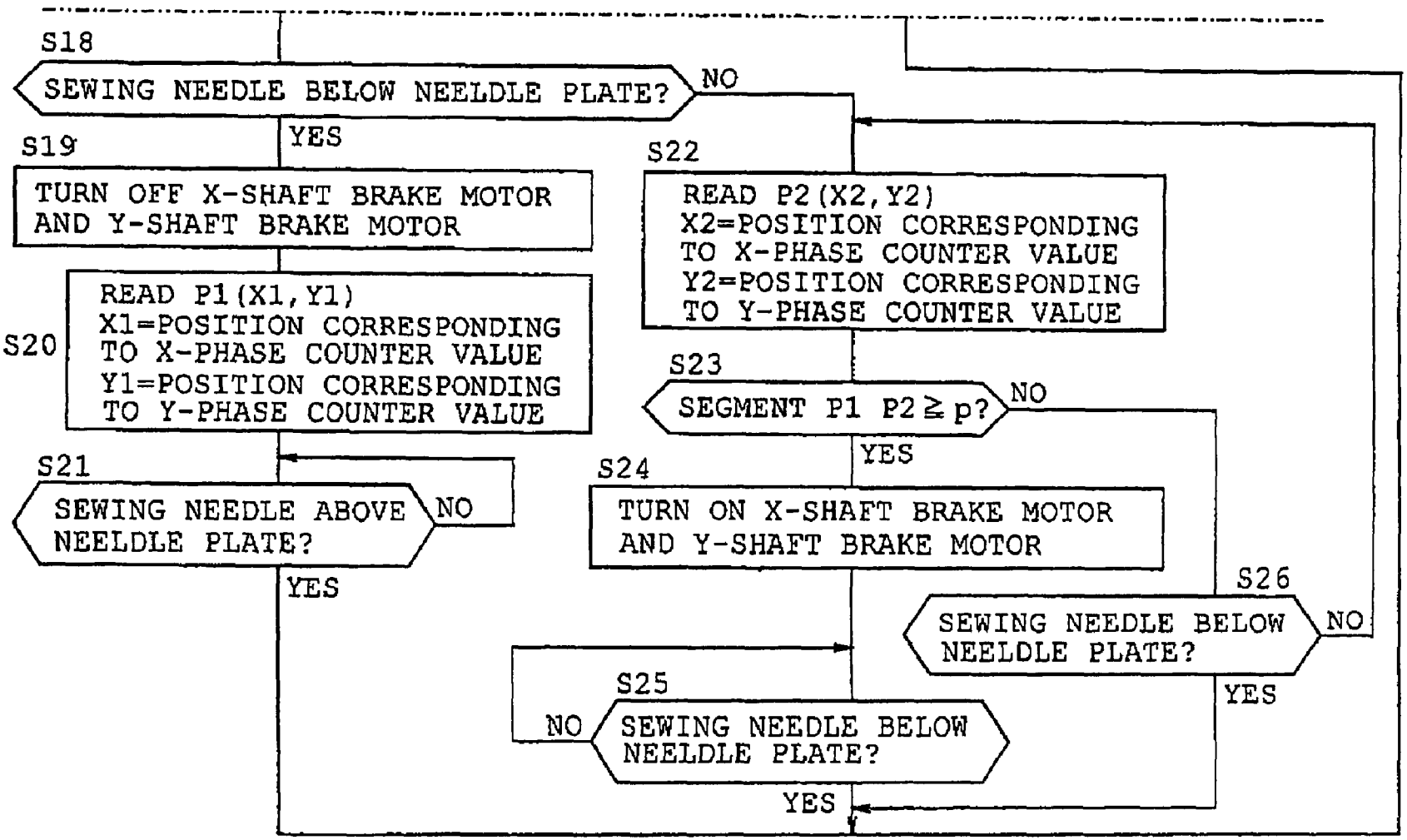

The operation of the above described configuration will be described with reference to FIGS. 6A and 6B. When executing a free motion sewing operation, workpiece cloth CL is placed on carrier 11 by the user and the free motion sewing mode is selected through touch panel 9*a*. Responsively, presser foot 6*a* is lifted by 1 mm to 2 mm from workpiece cloth CL, for example to start the sewing operation in free motion sewing mode. Flowchart indicated in FIGS. 6A and 6B shows the process flow of controller 40 in free motion sewing mode. Reference symbols Si (i=11, 12, 13 . . . ) indicate each step of the process flow.

First, stitch-pitch setting is executed through user operation of touch panel 9*a* (step S11). Stitch-pitch setting is made by the user's specification of desired stitch pitch such as 2.5 mm on a stitch-pitch setting screen (not shown) displayed on LCD 9. The specified stitch pitch represented as stitch pitch p is stored in the aforementioned memory of RAM 43.

Next, controller 40 initiates counting of incoming detection signals from X-shaft encoder 25 and Y-shaft encoder 33, respectively (step S12). In this case, the count (X-phase count) is incremented or decremented every time a detection signal is received from X-shaft encoder 25. Similarly the count (Y-phase count) is incremented or decremented every time a detection signal is received from Y-shaft encoder 33. The current position of carrier 11 is calculated based on the X-, Y-phase counts.

Then initialization (steps S13) is carried out to initialize sewing machine motor 4 to a halt if it is driven and to de-energize X-shaft brake motor 22 and Y-shaft brake motor 29 if energized so that carrier 11 can be moved freely in the X- and Y-directions, in other words, so that braking force of brake motors 22 and 29 are inoperative. When start/stop switch 8*a* is operated in such state (step S14: Yes), the coordinates of the current position of carrier 11 represented as reference position P1 (X1, Y1) is read from the memory of RAM 43 (step S15).

Then, sewing machine motor 4 is started (step S16) to rotate the sewing machine main shaft and drive the needle bar. The free motion sewing operation is started in the above described manner. By turning speed adjustment dial 8*b*, the user is allowed to make adjustments in rotational speed of the main shaft (sewing speed) most suitable to the user's technical maturity. The ongoing sewing operation can be stopped (process flow returns to step S13) if start/stop switch 8*a* is operated again (step S17: Yes).

During free motion sewing (step S17: No), the user is allowed to sew workpiece cloth CL by moving workpiece cloth CL in a given direction by manually moving carrier 11. Based on the incoming detection signal from needle position sensor 7, a determination is made as to whether or not sewing needle 5 is positioned below needle plate 1*a* (whether or not workpiece cloth CL is pierced by sewing needle 5) (step S18).

If sewing needle 1*a* is positioned below needle plate 1*a* (step S18: YES), both X-shaft and Y-shaft brake motors 22 and 29 are de-energized (step S19), and coordinates of the current position of carrier 11 represented as reference position P (X1, Y1) is read from RAM 43 (step S20). Then at step S21, a determination is made as to whether or not sewing needle 5 is positioned above needle plate 1*a* and if so (step S21: Yes), process flow is returned to step S17.

If sewing needle 5 is determined to be positioned above needle plate 1*a* at step S18 (step S18: No), the current position P2 (X2, Y2) of carrier 11 is read from RAM 43 (step S22). Then, at steps S23, the length of segment P1-P2 (refer to FIG. 8) or movement amount ΔP representing the amount of movement of carrier 11 from reference position P1 (X1, Y1) to the current position P2 (X2, Y2) can be given by the following equation.

$$\Delta P=[(X2-X1)^2+(Y2-Y1)^2]^{1/2}$$

Movement amount ΔP is compared with stitch pitch p specified by the user through touch panel 9*a*, and if ΔP≧p, that is if determined that movement amount of carrier 11 is equal to or greater than the stitch pitch p (step S23: Yes), X-shaft brake motor 22 and Y-shaft brake motor 29 are controlled to an unrotatable state (step S24). This means that X-shaft brake motor 22 as well as Y-shaft brake motor 29 simultaneously prohibit X-directional and Y-directional movement of carrier 11 to disallow the user from moving workpiece cloth CL (carrier 11). Then at step 25, determination is made as to whether or not sewing needle 5 is below needle plate 1*a* and if so (step S25: Yes), process is returned to step S17.

On the other hand, if determined at step S23 that movement amount ΔP of carrier 11 is less than stitch pitch p (step S23: Yes) and if sewing needle 5 is above needle plate 1*a* (step S26: No), steps S22, 23, and 26 are repeated to allow workpiece cloth CL to be moved freely by the user. Then, at step S26 if sewing needle 5 is below needle plate 1*a* (step S26; Yes), process returns to step S17.

As described above, free motion sewing involves stitch-by-stitch control of X-shaft brake motor 22 and Y-shaft brake motor 29. Thus, feed amount of workpiece cloth CL per stitch by the user, in other words, the stitch pitch of the stitch formed on workpiece cloth CL can be substantially equalized with the specified stitch pitch p.

Sewing machine M of the present exemplary embodiment is also capable of sewing straight linear stitches in free motion sewing mode in addition to free hand curving stitches. A description will be given hereinafter on control of sewing straight stitches.

Figure 7:
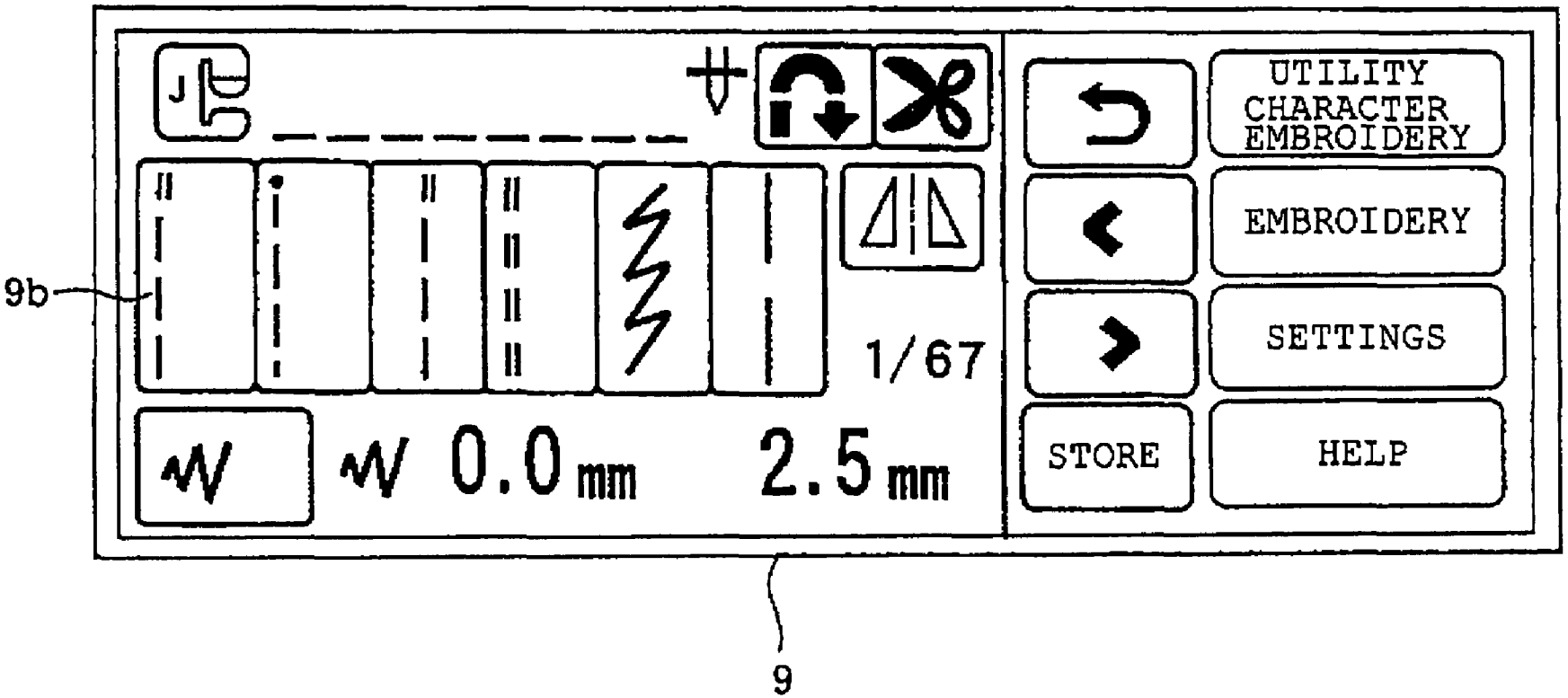
FIG. 7 is an exemplary view of sew patterns shown on a display.
Figure 8:
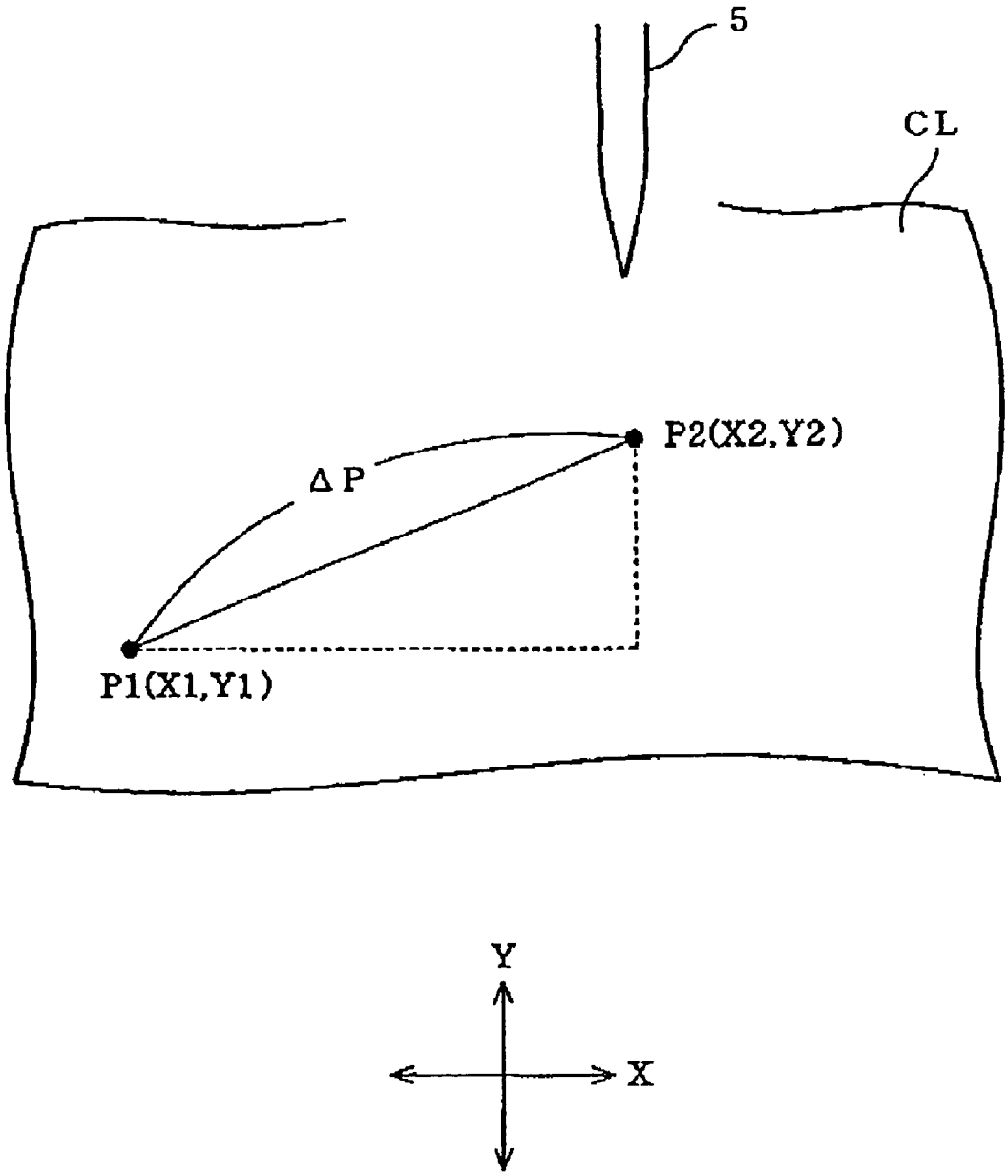
FIG. 8 is a descriptive view describing a reference position and a current position of the carrier.

Sew control of straight stitches in free motion sewing mode is started in response to the selection of free motion sewing mode at touch panel 9*a* and selection of straight stitch categorized as utility pattern through touch key 9*b* (refer to FIG. 7). Control of straight stitching differs from control of the free motion sewing mode described earlier in the following respects.

Step 13 of FIG. 6A is replaced by an initialization process in which Y-shaft brake motor 29 alone is de-energized while keeping X-shaft brake motor 22 energized. Further, step S19 is replaced by a control in which Y-shaft brake motor 29 alone is de-energized. As a result, excitation of X-shaft brake motor 22 is maintained during the sewing operation of straight stitches; stated differently, only Y-directional movement is permitted. Further, movement amount ΔP of carrier 11 (Y2-Y1) is compared with stitch pitch p, and if the movement amount (Y2-Y1) is determined to be equal to or greater than stitch pitch p, braking force is effected on the Y-directional movement of carrier 11 as well. The above described configuration only requires the Y-directional movement amount of carrier 11 to be calculated by equation "ΔP=Y2−Y1≧p" at step S23, and eliminates the need for counting the detection signals from X-shaft encoder 25 at step S12 and reading and calculation of current X-directional location X1 and X2 of carrier 11 at steps S15, 20, 22 and 23.

As described above, straight stitching in free motion sewing mode only allows carrier 11 carrying the workpiece cloth CL to be moved manually in the Y-direction only, and Y-shaft brake motor 29 is controlled stitch-by-stitch so that stitch pitch p is not exceeded at any point in time. As a result, feed amount of workpiece cloth CL per stitch by the user, in other words, the stitch pitch of the stitch formed on workpiece cloth CL can be substantially equalized with the specified stitch pitch p to allow formation of neat, Y-directionally extending straight stitches in substantially uniform stitch pitch to be formed on workpiece cloth CL.

Straight stitching in free motion sewing mode may alternatively prohibit Y-directional movement of carrier through control of Y-shaft brake motor 29 and prohibit X-directional movement of carrier 11 from exceeding stitch pitch p through control of X-shaft brake motor 22. In such case, carrier 11 carrying workpiece cloth CL forms neat X-directionally extending stitches on workpiece cloth CL. Though not described in detail, a selection switch may be further provided for use with sewing machine M to allow the user to select the direction in which the movement is to be prohibited so that the direction of movement of carrier 11 may be switched as required according to user preference.

As described above, sewing machine M of the present exemplary embodiment is configured to movably support carrier 11 that carries workpiece cloth CL and control movement amount ΔP of carrier 11 so that is does not exceed stitch pitch p through control of X-shaft brake motor 22 and Y-shaft brake motor 29 by controller 40. Such configuration allows stitch pitch to be substantially uniform during free motion sewing without altering the rotational speed of sewing machine motor 24, which in turn allows even inexperienced users to move workpiece cloth CL in an appropriate amount under the sewing speed specified in accordance with the user's technical maturity. Since stitches are controlled so as not to exceed stitch pitch p, neat stitches with substantially uniform stitch pitch can be formed on workpiece cloth CL.

Carrier 11 carrying workpiece cloth CL is supported movably in the X and Y directions on a given plane over bed 1 by carrier support 10, and thus, workpiece cloth CL can be moved (fed) smoothly by manual operation. Regulation of X-directional movement of carrier 11 is rendered by X-shaft brake motor 22 and X-shaft transmission mechanism 23 that transmits X-directional movement by transforming the X-directional movement into a rotary movement of X-shaft brake motor 22. The above configuration allows X-directional movement to be prohibited by merely rendering X-shaft brake motor 22 unrotatable. Similarly, regulation of Y-directional movement of carrier 11 is rendered by Y-shaft brake motor 29 and Y-shaft transmission mechanism 30 that transmits Y-directional movement by transforming the Y-directional movement into a rotary movement of Y-shaft brake motor 29 and thus, Y-directional movement can likewise be prohibited by merely rendering Y-shaft brake motor 29 unrotatable. The above described configuration allows the mechanism for prohibiting the movement of carrier 11 to be simplified.

Needle position sensor 7 is provided for sensing the vertical positioning of the needle bar having sewing needle 5 attached to it. Controller 40 is configured to control X-shaft brake motor 22 and Y-shaft brake motor 29 upon stitch-by-stitch sensing of stitch position sensor 7. Such configuration allows a sensitive, stitch-by-stitch control of the regulator by controller 40 during free motion sewing mode, to improve the accuracy of control and obtain uniformity in stitch pitch.

X-shaft encoder 25 and Y-shaft encoder 33 each configured by a rotary encoder are provided with X-shaft brake motor 22 and Y-shaft brake motor 29 to keep the configuration for sensing movement amount ΔP as simple and low cost as possible.

In straight stitching under the free motion sewing mode, either of X-shaft brake motor 22 or Y-shaft brake motor 29 is controlled to prohibit either the X-directional or the Y-directional movement of carrier 11 and the remaining other brake motor is controlled so that the amount of movement of carrier 11 in the permitted other direction does not exceed stitch pitch p. Such configuration allows neat straight stitches to be formed in uniform stitch pitch even in free motion sewing mode by allowing carrier 11 to be moved in either the X or Y direction.

The present disclosure is not limited to the above described or shown exemplary embodiment but may be modified or expanded as follows. The present disclosure is not limited to general household sewing machine application, represented as sewing machine M in the present exemplary embodiment, but may be applied to sewing machines in general that are provided with a carrier for placing the workpiece cloth and a support element for movably supporting the carrier.

In the above described embodiment, start and stop of sewing operation is instructed through operation of start/stop switch 8*a* and sewing speed is set through operation of speed adjustment dial 8*b*. Alternatively, sewing may be started or stopped and be adjusted in speed by a foot controller not shown known in the art. In such case, a connection cord not shown extending from the foot controller that terminates in a plug not shown is plugged into a jack 48 (refer to FIG. 1) of sewing machine M. After establishing the connection, the foot controller is depressed to start or stop the sewing operation and adjustment is made in sewing speed depending on the amount of depression.

Needle position sensor 7 may be replaced by any element that allows sensing of vertical positioning of the needle bar having sewing needle 5 attached to it. One of such example may be an encoder (rotational angle detector) configured to detect rotational angle of the sewing machine main shaft. X-shaft encoder 25 and Y-shaft encoder 33 may be replaced by any elements that can be provided on X- and Y-brake motors 22 and 29 or their replacements and on carrier 11 and that allow detection of movement amount of carrier 11.

X-shaft brake motor 22 and Y-shaft brake motor 29 may be replaced by any elements that prohibit movement of carrier 11. One of such examples may be a couple of brake motors provided integrally with mechanical brakes to effect braking to prohibit movement of carrier 11. Alternatively, an actuator such as a solenoid may be provided at carrier support 10 to directly prohibit the X-directional movement of carrier 11 when driven such that an abutting element secured on a drive shaft of the actuator is placed in direct abutment with movable frame 17 at a position to prevent its movement in the intended direction (X-direction). Similarly solenoid may be provided to directly prohibit the Y-directional movement of carrier 11 when driven such that an abutting element secured on a drive shaft of the actuator is placed in direct abutment with elements such as carriage 14 to prevent movement of carrier 11 in the Y-direction.

Carrier support 10 may come in any form if it is capable of movably supporting carrier 11 in two predetermined directions on a given plane. Thus, carrier 11 may be configured to be supported movably in a rotary direction θ and a radial direction R. In such case, the regulator is configured by a θ-direction motor, a θ-direction transmission mechanism that transmits rotary movement of carrier 11 to the θ-directional motor, an R-directional motor, and an R-directional transmission mechanism that transmits radial movement of carrier 11 into a rotary movement of the R-direction motor. Under such configuration, if a circular sewing pattern is selected in free motion sewing mode through touch panel 9*a*, controller 40 controls the R-directional motor to prohibit radial movement of carrier 11 and controls the θ-directional motor such that rotary movement amount of carrier 11 does not exceed stitch pitch p to form neat circular stitches with a substantially uniform stitch pitch on workpiece cloth CL. If straight stitching is selected in free motion sewing mode, controller 40 controls the θ-directional motor to prohibit the rotary movement of carrier 11 and controls the R-directional motor such that radial movement amount of carrier 11 does not exceed stitch pitch p to form neat straight stitches with a substantially uniform stitch pitch to be formed on workpiece cloth CL.

Computer readable medium that stores the control program is not limited to ROM 42 of controller 40, but may come in various forms such as a CD-ROM, a flexible disk, a DVD, and a memory card. In such case, by reading and executing the computer readable medium with the computer provided in the controller of the sewing machine, the operation and effect of the above described exemplary embodiment can be achieved. Further, the present disclosure may be reduced to practice through modification without deviation from the original concept of the disclosure such as alternatively configuring the transmission mechanism with a pinion and rack arrangement for transmitting the liner movement of carrier 11 through transformation into rotary movement.

While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine capable of sewing a manually moved workpiece cloth in free motion, comprising:

a carrier that carries the workpiece cloth and being manually moved to move the workpiece cloth;

a support element that movably supports the carrier;

a movement amount detector that detects an amount of carrier movement;

a specifier that specifies a stitch pitch;

a comparator that produces a comparison of the amount of carrier movement with the stitch pitch;

a regulator provided at the support element and that regulates carrier movement, the regulator including a brake motor and a transmission mechanism that transforms carrier movement oriented in a predetermined direction into a rotary movement of the brake motor; and a controller that controls the regulator such that the amount of carrier movement does not exceed the stitch pitch by controlling the brake motor into an unrotatable state through the transmission mechanism when determining that the amount of carrier movement is equal to or greater than the stitch pitch based on the comparison produced by the comparator.

2. The sewing machine of claim 1, further comprising a needle bar having a sewing needle attached to it and a needle position detector producing a detection of vertical positioning of the needle bar, wherein the controller is configured to execute a stitch-by-stitch control of the regulator based on the detection produced by the needle position detector.

3. The sewing machine of claim 1, wherein the movement amount detector comprises a rotary encoder provided at the regulator or the carrier.

4. The sewing machine of claim 1, wherein the carrier is supported by the support element so as to be movable in two predetermined directions on a given plane and the regulator is provided in a pair where each regulator of the pair regulates either of the two predetermined directions, and wherein the controller controls either of the regulators of the pair such that carrier movement in either of the two predetermined directions is prohibited, and controls the remaining other regulator such that the amount of carrier movement in the remaining other direction does not exceed the stitch pitch.

5. A non-transitory computer readable medium storing a control program for sewing a manually moved workpiece cloth in free motion with a sewing machine including a carrier that carries the workpiece cloth and being manually moved to move the workpiece cloth, a support element that movably supports the carrier, a movement amount detector that detects an amount of carrier movement, a specifier that specifies a stitch pitch, a regulator provided at the support element and that regulates carrier movement, the regulator including a brake motor and a transmission mechanism that transforms carrier movement oriented in a predetermined direction into a rotary movement of the brake motor, the control program stored in the computer readable medium, comprising:

instructions for producing a comparison of the movement amount of the carrier with the stitch pitch and instructions for controlling the regulator such that the amount of carrier movement does not exceed the stitch pitch by controlling the brake motor into an unrotatable state through the transmission mechanism when determining that the amount of carrier movement is equal to or greater than the stitch pitch based on the comparison.

6. The medium of claim 5 for use in a sewing machine further provided with a needle bar having a sewing needle attached to it and a needle position detector that produces a detection of vertical positioning of the needle bar, the control program stored in the medium further comprising instructions for executing a stitch-by-stitch control of the regulator based on the detection produced by the needle position detector.

7. The medium of claim 5 for use in a sewing machine wherein the carrier is supported by the support element so as to be movable in two predetermined directions on a given plane and the regulator is provided in a pair where each regulator of the pair regulates either of the two predetermined directions, the control program stored in the medium further comprising instructions for controlling either of the regulators of the pair such that carrier movement in either of the two predetermined directions is prohibited, and instructions for controlling the remaining other regulator such that the amount of carrier movement in the remaining other direction does not exceed the stitch pitch.

* * * * *